US006952091B2

(12) United States Patent
Bansal

(10) Patent No.: US 6,952,091 B2
(45) Date of Patent: Oct. 4, 2005

(54) INTEGRATED LOW DROPOUT LINEAR VOLTAGE REGULATOR WITH IMPROVED CURRENT LIMITING

(75) Inventor: Nitin Bansal, Gurgaon (IN)

(73) Assignee: STMicroelectronics Pvt. Ltd. (IN)

( * ) Notice: Subject to any disclaimer, the term of this patent is extended or adjusted under 35 U.S.C. 154(b) by 0 days.

(21) Appl. No.: 10/731,884

(22) Filed: Dec. 9, 2003

(65) Prior Publication Data

US 2004/0178778 A1 Sep. 16, 2004

(30) Foreign Application Priority Data

Dec. 10, 2002 (IN) ..... 1237/DEL/2002

(51) Int. Cl.[7] ..... G05F 1/573
(52) U.S. Cl. ..... 323/277
(58) Field of Search ..... 323/274–277, 323/313–316; 361/18

(56) References Cited

U.S. PATENT DOCUMENTS 5,539,603 A * 7/1996 Bingham ..... 361/56
6,407,537 B2 * 6/2002 Antheunis ..... 323/312
6,664,773 B1 * 12/2003 Cunnac et al. ..... 323/277
6,822,428 B2 * 11/2004 Miyanaga et al. ..... 323/284

* cited by examiner

*Primary Examiner*—Gary L Laxton
(74) *Attorney, Agent, or Firm*—Jenkens & Gilchrist, P.C.

(57) ABSTRACT

An integrated Low Dropout (LDO) linear voltage regulator provides improved current limiting. A differential voltage amplifier compares an output voltage to reference voltage and controls a pass transistor to make the output voltage substantially match the reference voltage. This is accomplished by sensing the output voltage of the voltage regulator for application to a first input of the differential amplifier and coupling a second input of the differential amplifier to the reference voltage. A current sense transistor utilizes current mirroring techniques to sense the current passing through the pass transistor to the output. This sensed current is compared to a reference current. The result of that comparison is fed back to the differential voltage amplifier to in a manner that increases the apparently sensed output voltage in situations where the sensed current exceeds the reference current.

15 Claims, 3 Drawing Sheets

Prior Art

INTEGRATED LOW DROPOUT LINEAR VOLTAGE REGULATOR WITH IMPROVED CURRENT LIMITING

PRIORITY CLAIM

The present application claims priority from Indian Application for Patent No. 1237/De1/2002 filed Dec. 10, 2002, the disclosure of which is hereby incorporated by reference.

BACKGROUND OF THE INVENTION

1. Technical Field of the Invention

The present invention relates to integrated low dropout linear voltage regulators and, in particular, to low dropout linear voltage regulators providing improved current limiting.

2. Description of Related Art

Linear voltage regulators are widely used in the power supply circuits of electronic designs. In many applications these regulators are required to operate with small input-output voltage differentials. Low dropout (LDO) linear voltage regulators are a class of linear voltage regulators that are specifically designed to provide this capability. Linear voltage regulators, including LDOs, also normally incorporate special circuitry for protecting both the load and the regulator under abnormal conditions such as "overload." The most common protection mechanism used is "current limiting." The vast majority of integrated linear voltage regulators (linear voltage regulators implemented in the form of monolithic integrated circuits) incorporate such protection mechanisms.

For implementing current limiting, the regulator circuit includes an arrangement to sense the current conducted by the output transistor and limit that current to a predetermined safe maximum value when overload occurs, such as an output short-circuit.

The most common method to provide current limiting is by providing a resistor in series with the output and sensing the voltage drop. The voltage drop across the resistor, which is proportional to the output current of regulator, is compared with a preset voltage. The drive to the output transistor is then limited or cutoff if the sensed voltage exceeds the predefined voltage.

U.S. Pat. No. 4,851,953 describes a low drop out voltage regulator based on this principle. According to this invention a series resistor is inserted in the output current path to sense the output current as shown in FIG. 1. The voltage drop across this sense resistance is proportional to the output current of regulator and is fed back to a current limit circuit which controls the drive of the output transistor to limit the current. This arrangement suffers from the drawback that the sense resistor causes a voltage drop leading to an undesired increase in voltage dropout.

U.S. Pat. No. 4,254,372 describes a current sensing method for Low Dropout regulators. In this method, instead of inserting a resistor in the output path, a sense resistance is inserted in the path of the base current drive of the PNP series pass transistor. The base current is sensed through the sense resistance and is used to control the output current by limiting the base current to a predetermined value corresponding to a maximum allowable load current. However, this arrangement can only be used when the output pass transistor is a Bipolar Junction Transistor (BJT). Modern integrated circuits based on Metal Oxide Semiconductor (MOS) transistors cannot therefore utilize this technique.

The technique is also not very convenient for BJT applications owing to the wide variation in current gain between individual series pass transistors.

SUMMARY OF THE INVENTION

A need exists in the art to obviate the above disadvantages and provide an LDO linear voltage regulator with improved current limiting. Preferably, such improved current limiting could be provided with a mechanism that is usable for both MOS and BJT implementations.

An embodiment of an integrated Low Dropout (LDO) linear voltage regulator providing improved current limiting in accordance with the present invention includes a 2-input, 1-output difference voltage amplifier. A reference voltage source is connected to a first input of the difference voltage amplifier. A ciruit is provided to sense the output voltage of the voltage regulator and couple it to the second input of the difference amplifier in a manner that provides negative feedback. A series pass transistor is connected to the output of the difference voltage amplifier, and a current sense transistor is coupled to the series pass transistor using current mirroring to monitor the current passing there through. A reference current source is coupled to the output of the current sense transistor, with the junction of the current sense transistor and the reference current source being connected to the difference voltage amplifier in a manner that increases the apparently sensed regulator output voltage as the current through the current sense transistor exceeds the reference current value.

In one embodiment, the difference voltage amplifier is a long-tailed pair having a constant current source for providing the tail current.

In one embodiment, the circuit for sensing the output voltage of the voltage regulator comprises a direct connection of the output of the voltage regulator to the second input of the difference amplifier.

In one embodiment, the junction of the current sense transistor and the reference current source is connected to the control terminal of a current limiting transistor that is connected in parallel with the transistor of the long-tailed pair that has its control terminal as the second input of the difference amplifier.

An embodiment of the present invention further provides a method for improving current limiting in an integrated low Drop Out (LDO) linear voltage regulator. A reference voltage source is connected to a first input of a difference voltage amplifier. The output voltage of the voltage regulator is sensed and coupled back to a second input of the difference amplifier in a manner that provides negative feedback. Current passing through the output of the difference voltage amplifier is sensed and compared to a reference current. The result is applied to the difference voltage amplifier in a manner that increases the apparently sensed regulator output voltage as the current through the current sense transistor exceeds the reference current value.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
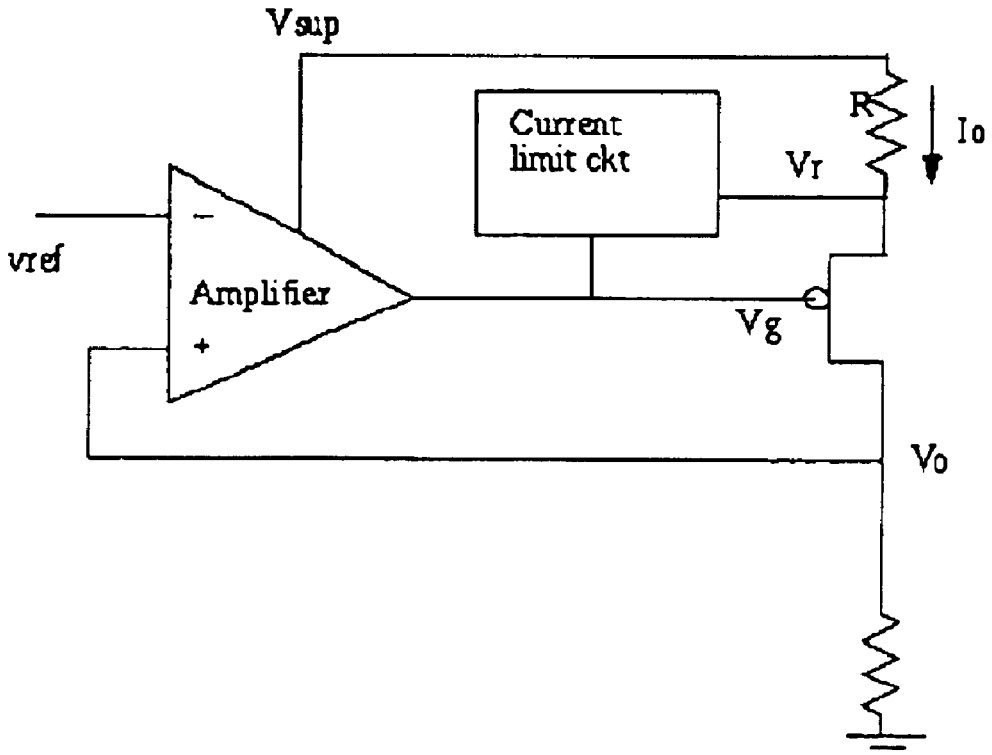
FIG. 1 shows a schematic block diagram of the prior art circuit for LDO.
Figure 2:
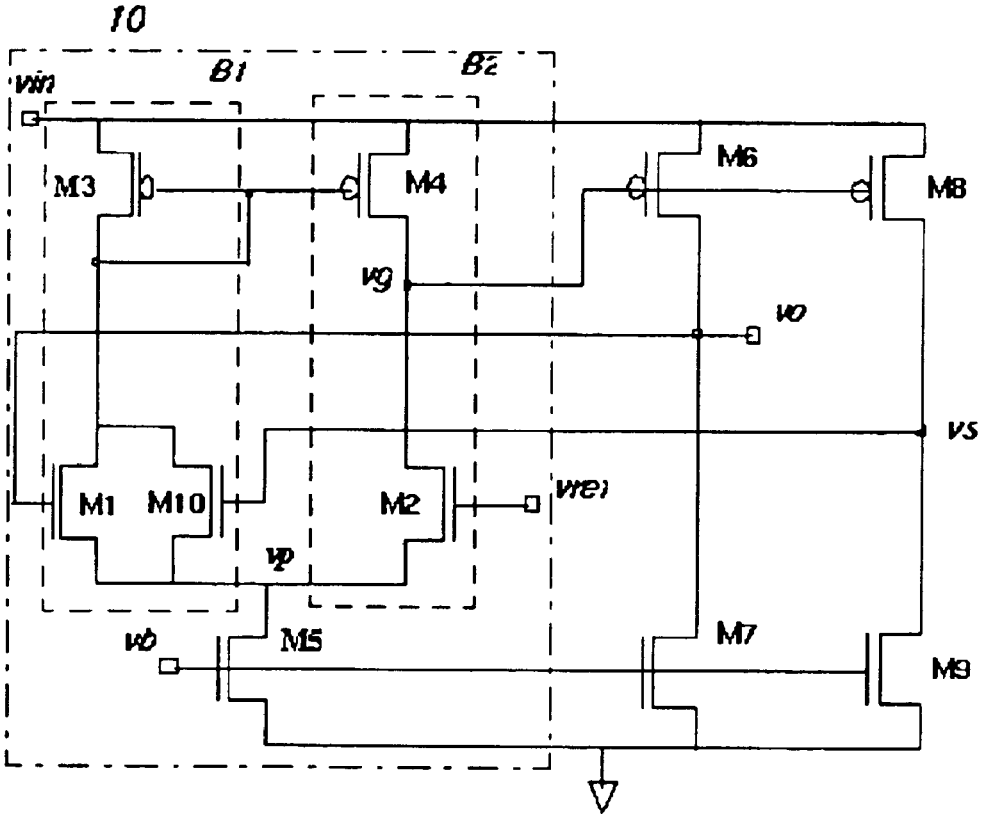
FIG. 2 shows a schematic circuit diagram of the LDO linear voltage regulator with improved current limiting in accordance with an embodiment of the present invention.

FIG. 2 shows a preferred embodiment of the improved LDO linear voltage regulator according to an embodiment of the invention. This embodiment is merely illustrative and is not intended to be limiting in any manner. For instance, the embodiment shows a Complementary Metal Oxide Semiconductor (CMOS) implementation, however a Bipolar (BJT) implementation is equally possible. Similarly, the embodiment shows a unity gain configuration for the regulator, though non-unity gain configurations are equally feasible.

Referring to FIG. 2, the improved LDO voltage regulator includes a differential amplifier 10 and an output stage incorporating current sensing and current limiting circuitry comprising two branches of pass transistors. Each branch comprises a pair of complementary transistors M6, M7, and M8, M9. The pass transistor M6, which is in one branch, and the corresponding current sense transistor M8, in the other branch, have their control terminals (gates) connected together at vg, and their source terminals connected together at the common supply terminal vin. Since both transistors are located on the same silicon die, are fabricated with the same process, are sized proportionately and are (preferably) located in close proximity to each other, this arrangement enables current sense transistor M8 to mirror the current flowing through series pass transistor M6. The two transistors are sized in proportion appropriately based on the requirements of the design. For instance, the M6-M8 size ratio could be 27,000 um/40 um whereby M8 would carry a current 675 times smaller than the current flowing through M6 at any point of time during the operation of the regulator. The drain terminal of the series pass transistor M6 which is the output vo of the regulator is also connected to the input terminal of the differential amplifier (at transistor M1) to provide unity gain feedback.

Transistors M5, M7 and M9 have their control (gate) terminal connected together at vb while their source terminals are connected to a common supply terminal (ground). This arrangement enables mirroring of currents in proportion to the relative sizes of these transistors. The common control terminal of these three transistors is connected through vb to an external fixed bias current source to provide predefined currents in these transistors. Transistor M5 provides the tail current for the differential amplifier. Transistor M7 is a biasing transistor connected in series with M6 to complete dc current path and ground any leakage currents. Transistor M9 provides a reference current limit.

The output terminal vo delivers a regulated voltage with respect to the output load current and input voltage vin. The output is fed to the non-inverting terminal of the differential amplifier (at transistor M1) to complete the feedback loop. The inverting input of differential amplifier (at transistor M2) is connected to the reference voltage vref.

The differential amplifier 10 acts as an error amplifier and amplifies any deviation of the output voltage with respect to the reference voltage to adjust the gate voltage vg of pass transistor M6. The differential amplifier is a double-input (at the gates of M1 and M2), single-output (at vg) active current mirror type differential amplifier. A first reference terminal of the differential amplifier (at the sources of M3 and M4) is connected to vin. A second reference terminal of the differential amplifier (at the sources of M1, M10 and M2) is coupled to ground through the tail current providing transistor M5. The pass transistors M3, M1, M10 and M4, M2 form two parallel branches B1 and B2 respectively of the differential amplifier. The pass transistors M3 and M4 form an active current mirror with transistors M1 and M2 providing non-inverting and inverting terminal of the differential amplifier respectively. A reference voltage vref is applied to the control terminal (gate) of the pass transistor M2 and the negative feedback voltage is applied from vo to the control terminal of the pass transistor M1.

The pass transistors M8, M9 and M10 together form the current sensing and limiting circuit. The transistors M8 and M9 have common drain connected to the gate of M10 as the current limiting feedback.

Figures 3A, 3B, 3C, 3D, 3E:
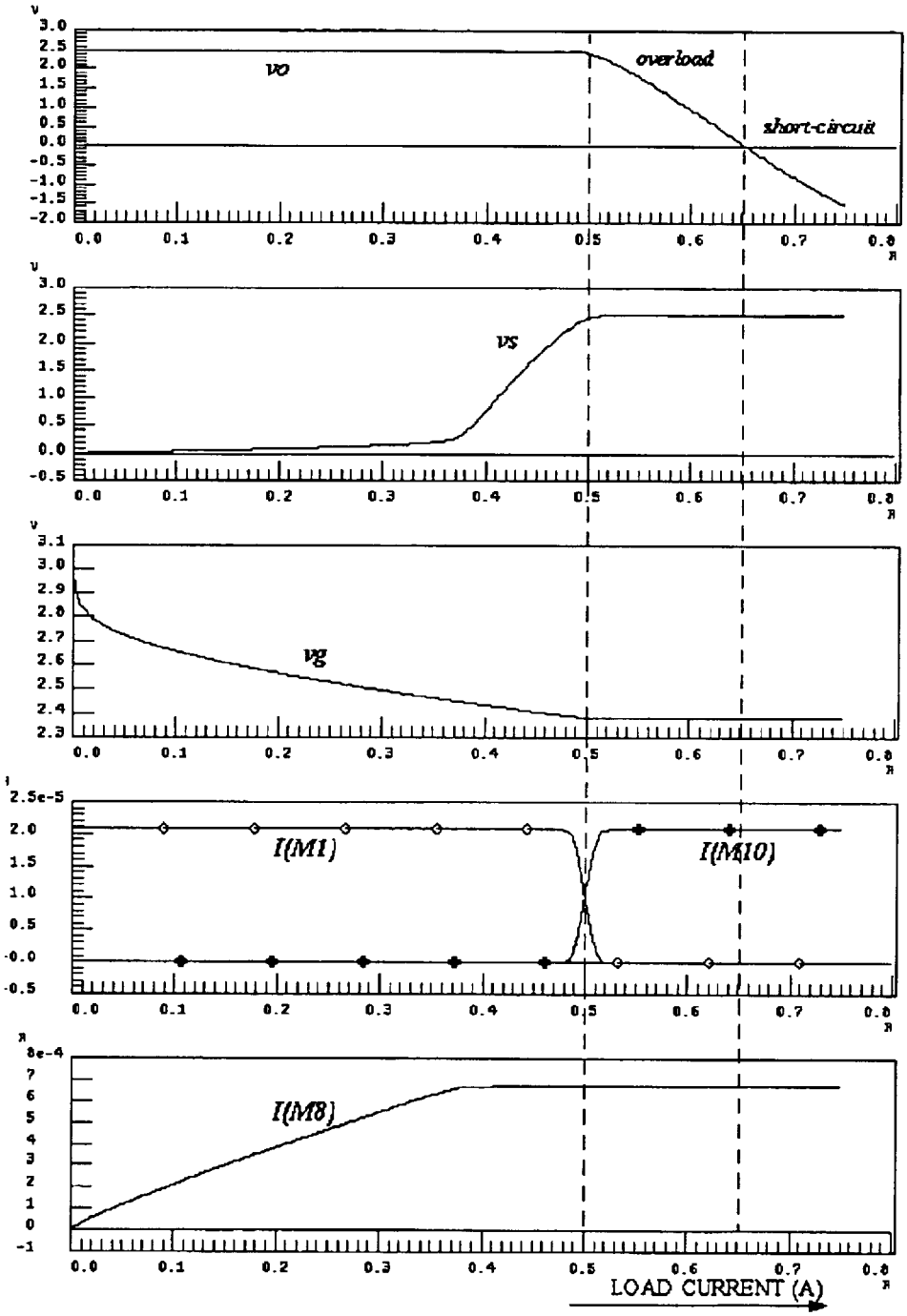
FIGS. 3*a*–3*e* show waveforms defining the operation of the current limiter in a LDO linear voltage regulator of FIG. 2.

The circuit operation can be understood from FIGS. 3*a*–3*e*. In general, the output vo sits at the same voltage level as vref because of negative feedback and voltage follower configuration used. When higher current is drawn from the load at the output, vo tends to decrease as shown in FIG. 3*a*. As vo is connected to the control terminal of the pass transistor M1, the decrease in vo causes the gate overdrive voltage of M1 to decrease. This reduced overdrive voltage of M1 results in a decrease of current through pass transistor M1. According to differential amplifier characteristics, a decrease in current of branch B1 results in a corresponding increasing in current in branch B2 and thus a lowering of vg. The decrease in vg increases the gate overdrive voltage of pass transistor M6 enabling it to provide higher current without appreciable fall in vo.

The output voltage vo and corresponding current through transistor M1 is allowed to decrease on demand of the higher output current until the output current reaches a desired/critical pre-decided current value which is set by the reference current flowing through M9. The reference current value can be set by properly sizing transistors in the current sensing and limiting branch of circuit. The pass transistor M8 whose size is proportional to M6 gives a current proportional to the load current. The current limit is determined by the empirical relation:

$$\frac{I_{out}}{I_s} = \frac{W_{M6}}{W_{M8}}$$

$$\text{i.e.} \quad \frac{600\ \text{mA}}{Is} = \frac{27000\ \text{um}}{40\ \text{um}}$$

$$\text{i.e.} \quad Is \sim 900\ \text{uA}$$

This would mean that M9 should be set for a reference current of 900 uA for a current limit of 600 mA.

If the current in the pass transistor M8 is less than reference current, then vs remains near zero. Thus, during the normal operation of the regulator when the load current being drawn is less than the set current limit, the transistor M10 would not be operational and the differential amplifier acts purely as an error amplifier. When the current in pass transistor M6 becomes comparable to the reference current, the vs node voltage starts increasing as shown in FIG. 3*b*.

The rising vs would not cause the bypass transistor M10 to turn on at lower currents because the source of M10 would already be sitting at a higher voltage of $$Vp = (vref - vtn) + \sqrt{\frac{i}{\beta}}$$

However, when vs increases by an amount vt (i.e., a threshold) above vp, the gate overdrive voltage for the pass transistor M10 becomes positive, and then transistor M10 will start to turn on.

Now, for any increase in the load current as vo decreases the normal phenomenon of decrease in transistor M1 current would be compensated by an overriding increase in current through pass transistor M10 maintaining the total current flowing through branch B1 constant. Because of this, the voltage at node vg does not fall any further and is clamped to this level as shown in FIG. 3*c*. Any further decrease in load impedance does not cause the gate voltage for driver transistor to decrease as required and therefore the output voltage would start falling sharply. At the short circuit of the output, the regulator will provide the pre-determined short-circuit current.

Because the transistor M10 becomes a part of a high-gain differential amplifier, as evident from the FIG. 3*d* and FIG. 3*e*, this current limiting arrangement has the advantage of fast response without requiring the addition of extra stages thus resulting in a very simple and efficient implementation. The current limiting circuit does not interfere with the normal operation of the voltage regulator and comes into operation only when the current approaches and exceeds the set limit. Another advantage of the present invention is the implementation of a soft start mechanism by the same circuit arrangement. When the regulator is switched on the load capacitor offers a virtual short circuit to ground. As large current would tend to flow under this condition, the current limiting circuit operates to limit the charging current at the pre-determined current limit. Thus, the capacitor is charged slowly using the maximum current limit thereby providing a soft start to the regulator.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. An integrated Low Dropout (LDO) linear voltage regulator providing improved current limiting, comprising:

a 2-input, 1-output differential voltage amplifier, a first input receiving a reference voltage;

a circuit to sense the output voltage of the voltage regulator and couple that sensed output voltage to a second input of the differential voltage amplifier in a manner that provides negative feedback;

a series pass transistor connected to the output of the difference voltage amplifier;

a current sense transistor coupled to the series pass transistor using current mirroring to monitor the current passing through the current sense transistor, a reference current source coupled to the output of the current sense transistor; and the junction of the current sense transistor and the reference current source being connected to the differential voltage amplifier in a manner that increases the sensed output voltage as the current through the current sense transistor exceeds the reference current value.

2. The integrated Low Dropout (LDO) linear voltage regulator as in claim 1, wherein the differential voltage amplifier is a long-tailed pair having a constant current source for providing a tail current.

3. The integrated Low Dropout (LDO) linear voltage regulator as in claim 1, wherein the circuit for sensing the output voltage of the voltage regulator comprises a direct connection of the output of the voltage regulator to the second input of the difference amplifier.

4. The integrated Low Dropout (LDO) linear voltage regulator as in claim 2, wherein the junction of the current sense transistor and the reference current source is connected to the control terminal of a current limiting transistor that is connected in parallel with the transistor of the long-tailed pair whose control terminal is connected to the second input of the difference amplifier.

5. A method for improving current limiting in an integrated low Drop Out (LDO) linear voltage regulator, comprising:

receiving a reference voltage at a first input of a difference voltage amplifier;

sensing a regulator output voltage;

applying the sensed regulator output voltage to a second input of the difference voltage amplifier in a manner that provides negative feedback;

sensing current passing through the regulator output;

comparing the sensed current to a reference current; and controlling operation of the difference voltage amplifier in a manner that increases the sensed regulator output voltage if the sensed current exceeds the reference current.

6. The method as in claim 5, wherein applying the sensed regulator output voltage comprises directly connecting the sensed regulator output voltage to the second input of the difference voltage amplifier.

7. A low drop-out voltage regulator, comprising:

a differential amplifier stage including:

a differential amplifier having first and second differential inputs, the first differential input coupled to an output of the regulator and the second differential input coupled to a reference voltage; and a current control transistor coupled to a first branch of the differential amplifier; and an output stage including:

a pass transistor coupled between a regulator input and the regulator output and controlled by an output of the differential amplifier; and a current sensing transistor coupled between the regulator input and the current control transistor of the differential amplifier.

8. The regulator of claim 7 wherein a first reference terminal of the differential amplifier is coupled to the regulator input and a second reference terminal of the differential amplifier is coupled to ground.

9. The regulator of claim 8, wherein the differential amplifier stage further includes a tail current transistor coupled between the second reference terminal and ground.

10. The regulator of claim 7, wherein the output stage further includes a biasing transistor coupled between the pass transistor and ground.

11. The regulator of claim 7, wherein the output stage further includes a current limiting transistor coupled between the current sensing transistor and ground.

12. A regulator, comprising:

a regulator input;

a regulator output;

a differential amplifier coupled to the regulator input and having first and second current paths associated with corresponding first and second differential input and an output in the second current path, the first differential input coupled to the regulator output and the second differential input receiving a reference voltage;

a current control transistor coupled to the first current path;

a pass transistor coupled between the regulator input and regulator output and having a control terminal coupled to the differential amplifier input; and a current sensor to sense current at the regulator output and generate control signal applied to the current control transistor.

13. A method, comprising:

sensing an output regulated voltage;

comparing the output regulated voltage to a reference voltage;

controlling the output voltage through negative feedback to substantially match the reference voltage;

sensing a current associated with the output voltage;

comparing the sensed current to a reference current;

if the sensed current exceeds the reference current, then overriding the sensing of the output regulated voltage to sense a higher voltage.

14. A regulator, comprising:

a negative feedback voltage control circuit that senses an output regulated voltage and controls that sensed output regulated voltage to substantially match a reference voltage;

a current sensor that senses a current associated with the output regulated voltage and compares the sensed current to a reference current; and a feedback control circuit responsive to sensed current exceeding the reference current to override the negative feedback voltage control circuit sensing of the output regulated voltage to sense a higher voltage.

15. The regulator of claim 14 wherein the negative feedback voltage control circuit comprises:

a differential amplifier including first and second mirrored current paths, a current flowing in the first current path being controlled by the output regulated voltage, and a current flowing in the second current path controlling the sensed output regulated voltage to substantially match the reference voltage; and an override circuit coupled to the first current path and responsive to the feedback control circuit to maintain current flowing in the first current path as the output regulated voltage decreases.

* * * * *

UNITED STATES PATENT AND TRADEMARK OFFICE

CERTIFICATE OF CORRECTION

PATENT NO. : 6,952,091 B2
DATED : October 4, 2005
INVENTOR(S) : Nitin Bansal

It is certified that error appears in the above-identified patent and that said Letters Patent is hereby corrected as shown below:

Column 5,
Line 54, replace “transistor,” with -- transistor; --.

Column 7,
Lines 6-7, replace “generate control signal” with -- generate a control signal --.

Signed and Sealed this

Tenth Day of January, 2006

JON W. DUDAS
*Director of the United States Patent and Trademark Office*